US010227147B2

(12) United States Patent
Piepenbrock et al.

(10) Patent No.: US 10,227,147 B2
(45) Date of Patent: Mar. 12, 2019

(54) METHOD AND APPARATUS FOR MANUFACTURING PACKAGING UNITS IN A TUBULAR BAG FORMING, FILLING AND SEALING MACHINE

(71) Applicant: HASTAMAT VERPACKUNGSTECHNIK GMBH, Lahnau (DE)

(72) Inventors: Olaf Piepenbrock, Osnabrueck (DE); Horst Konstandin, Karlsbad (DE)

(73) Assignee: HASTAMAT VERPACKUNGSTECHNIK GMBH, Lahnau (DE)

( * ) Notice: Subject to any disclaimer, the term of this patent is extended or adjusted under 35 U.S.C. 154(b) by 381 days.

(21) Appl. No.: 14/895,042

(22) PCT Filed: May 21, 2014

(86) PCT No.: PCT/EP2014/060453

§ 371 (c)(1),
(2) Date: Dec. 1, 2015

(87) PCT Pub. No.: WO2014/195135

PCT Pub. Date: Dec. 11, 2014

(65) Prior Publication Data

US 2016/0114915 A1 Apr. 28, 2016

(30) Foreign Application Priority Data

Jun. 7, 2013 (DE) ..... 10 2013 210 633

(51) Int. Cl.
*B65B 9/20* (2012.01)
*B65B 63/02* (2006.01)
(Continued)

(52) U.S. Cl.
CPC ..... *B65B 9/20* (2013.01); *B65B 23/12* (2013.01); *B65B 35/44* (2013.01); *B65B 35/50* (2013.01);
(Continued)

(58) Field of Classification Search
CPC ..... B65B 23/12; B65B 61/04; B65B 63/02; B65B 39/12; B65B 35/44; B65B 9/20;
(Continued)

(56) References Cited

U.S. PATENT DOCUMENTS 4,394,899 A * 7/1983 Fluck ..... B65B 23/14 198/408
4,669,600 A * 6/1987 Fluck ..... B65B 23/14 198/408
(Continued)

FOREIGN PATENT DOCUMENTS

CN 201040598 Y 3/2008
CN 202244172 U 5/2012
(Continued)

OTHER PUBLICATIONS

The Patent Office of the People's Republic of China, First Office Action, Application No. 201480032614.6, dated Jul. 21, 2016.
(Continued)

*Primary Examiner* — Michelle Lopez
*Assistant Examiner* — Lucas Palmer
(74) *Attorney, Agent, or Firm* — Quarles & Brady LLP

(57) ABSTRACT

The invention relates to a method as well as to an apparatus for manufacturing packaging units in a tubular bag forming, filling and sealing machine. Separated products (46, 47) are transferred to a portioning device (20) by means of a horizontal conveyor (18) in order to manufacture portion units (21) with a defined arrangement and number of products, and the portion units, which are enveloped by a film web (34), are subsequently conveyed to a separating device with the help of a vertical conveyor (22) in order to separate the packaging units. The portioning device is used both to
(Continued)

Figure 1:
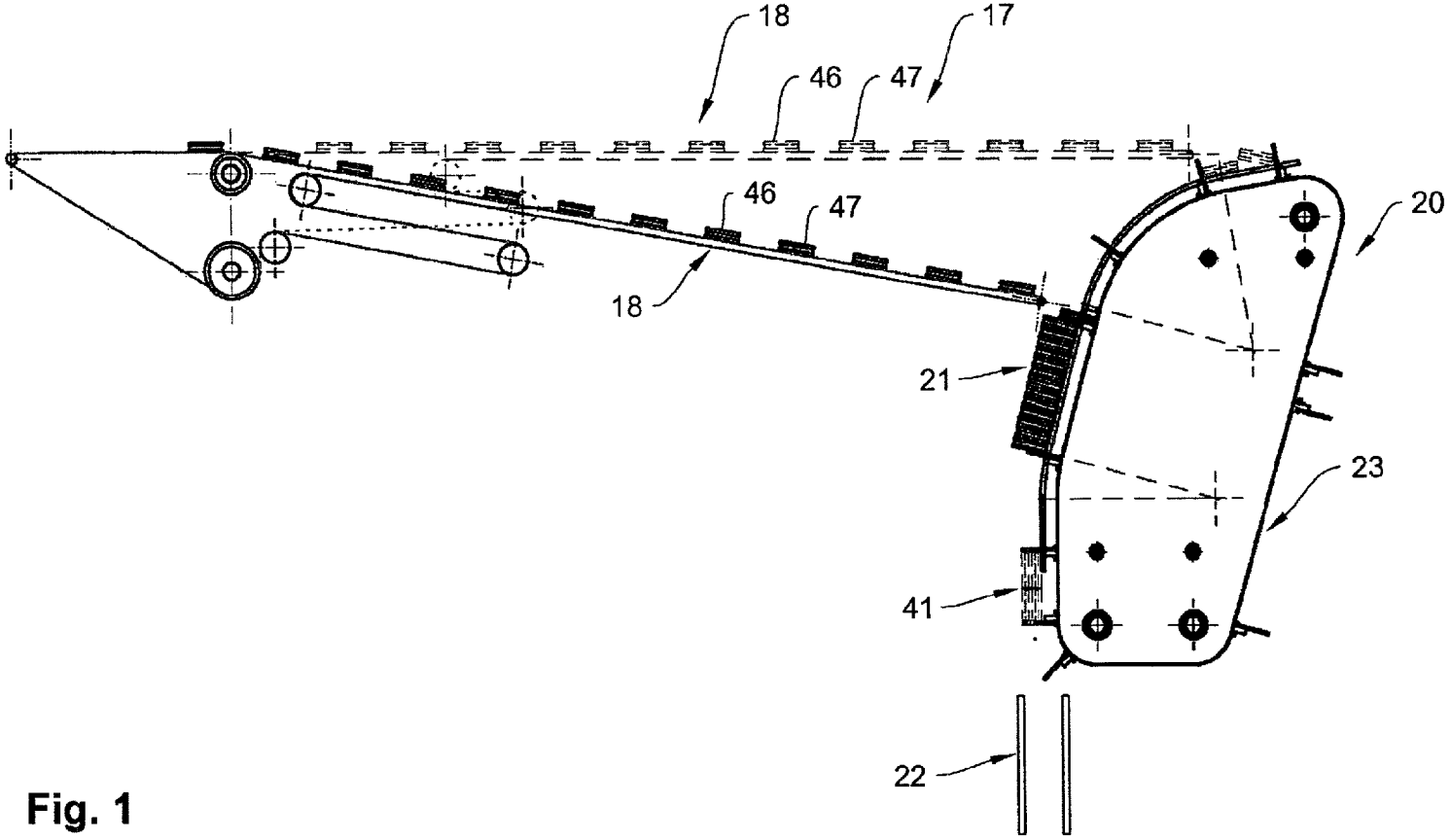

manufacture the portion units and to synchronize the portioning device with the horizontal conveyor and the vertical conveyor.

17 Claims, 9 Drawing Sheets

(51) Int. Cl.
*B65B 39/12* (2006.01)
*B65B 61/04* (2006.01)
*B65B 35/50* (2006.01)
*B65B 35/44* (2006.01)
*B65B 23/12* (2006.01)

(52) U.S. Cl.
CPC ..... *B65B 39/12* (2013.01); *B65B 61/04* (2013.01); *B65B 63/02* (2013.01)

(58) Field of Classification Search
CPC .. B65B 5/101; B65B 9/06; B65B 9/08; B65B 9/067; B65B 31/045; B65B 35/50
USPC ..... 53/438, 459, 546, 554, 469
See application file for complete search history.

(56) References Cited

U.S. PATENT DOCUMENTS 5,052,166 A * 10/1991 Ziegler ..... B65B 9/067 53/433
6,158,570 A * 12/2000 Strasser ..... B65B 23/14 198/450
2010/0051041 A1* 3/2010 Boldrini ..... B65B 9/067 131/275
2011/0154783 A1* 6/2011 Bierschenk ..... B65B 1/22 53/436
2012/0027562 A1* 2/2012 Pocaterra ..... B65B 23/14 414/802
2015/0136564 A1* 5/2015 Hurni ..... B65B 57/16 198/418
2016/0114917 A1* 4/2016 Schmachtel ..... B65B 35/243 53/545
2016/0229566 A1* 8/2016 Schmachtel ..... B65B 35/50
2016/0229567 A1* 8/2016 Schmachtel ..... B65B 35/50

FOREIGN PATENT DOCUMENTS

DE 1045892 B * 12/1958 ..... B65B 23/14
DE 2118743 A1 * 11/1972 ..... B65B 35/50
DE 102011102245 A1 11/2012
EP 2524874 A1 * 11/2012 ..... B29C 65/08

OTHER PUBLICATIONS

PCT International Search Report, PCT/EP2014/060453, dated Aug. 4, 2014.
PCT English Language Translation of the International Preliminary Report on Patentability, PCT/EP2014/060453, dated Dec. 17, 2015.

* cited by examiner

METHOD AND APPARATUS FOR MANUFACTURING PACKAGING UNITS IN A TUBULAR BAG FORMING, FILLING AND SEALING MACHINE

CROSS-REFERENCE TO RELATED APPLICATIONS

This application represents the national stage entry of PCT International Application No. PCT/EP2014/060453 filed May 21, 2014, which claims priority of German Patent Application No. 10 2013 210 633.5 filed Jun. 7, 2013, the disclosures of which are incorporated by reference here in their entirety for all purposes.

The invention relates to a method for manufacturing packaging units in a tubular bag forming, filling and sealing machine, in which separated products are transferred to a portioning device by means of a horizontal conveyor in order to manufacture portion units with a defined arrangement and number of products, and the portion units, which are enveloped by a film web, are subsequently conveyed to a separating device with the help of a vertical conveyor in order to separate the packaging units. Moreover, the invention relates to an apparatus for manufacturing packaging units in a tubular bag forming, filling and sealing machine, having a horizontal conveyor for transferring separated products to a portioning device in order to manufacture portion units with a defined arrangement and number of products, and having a vertical conveyor for conveying the portion units, which are enveloped by a film web, to a separating device in order to separate the packaging units.

When manufacturing packaging units from a multiplicity of products which are supplied in a separated fashion, and which are provided with a film tube for being enveloped, the products being supplied in a separated fashion are initially united in portion units in a defined relative arrangement. Subsequently, said portion units are provided with the film tube envelope in order to then finally obtain separated packaging units by means of a cut-through of the film tube at defined locations.

Two interfaces result from the procedure outlined hereinbefore, when continuously manufacturing the packaging units, at which interfaces a synchronization between different conveyor installations has to be effected.

For one thing, a synchronization between the horizontal conveyor supplying the products in a separated fashion and the portioning device has to be carried out since, in the portioning device, the relative arrangement of the separated products for manufacturing portion units is altered. For instance, with portion units having the products that have been separated beforehand in a stacking arrangement, both the distances between the individual products and their spatial orientation with respect to one another have to be altered. This, for instance, requires a corresponding deceleration of a portioning device that is operated in a circulating fashion when the separated products are taken over from the horizontal conveyor.

A further synchronization has to be effected when transferring the products being united in portion units in the portioning device to the vertical conveyor, in which the film web is simultaneously conveyed in order to realize the envelope for the portion units.

The present invention is based on the task of procuring a method and an apparatus allowing both for a synchronization between the horizontal conveyor and the portioning device and for a synchronization between the portioning device and the vertical conveyor, with the smallest possible device-related expenditure.

This task is solved by a method having the features of claim 1 and by an apparatus having the features of claim 16.

In the method in accordance with the invention, both the synchronization between the horizontal conveyor and the portioning device and the synchronization between the portioning device and the vertical conveyor are effected by means of the portioning device itself. In the method in accordance with the invention, a special device is hence not envisaged for performing the dual synchronization. Instead, the portioning device that is needed for manufacturing the portion units in any case is simultaneously employed for synchronization.

In accordance with a preferred variant of the method, the synchronization is performed by the portioning device by means of at least one pair of stops including two portioning stops that circulate independently of each other on a circulating conveyor, namely a leading guide stop and a trailing end stop, resting against the products in order to realize a portion unit that is composed of products that rest against one another and being carried over, together with the portion unit being received therebetween, on the circulating conveyor from a take-over position for taking over products from the horizontal conveyor into a transfer position for transferring the products to the vertical conveyor.

The portion unit being received in a sandwich fashion between the guide stop and the end stop allows for transporting the portion unit independently of any gravity effects, such that the portion unit can be transported on the circulating conveyor to the vertical conveyor as a coherent and compact unit with products resting against one another, independently of any gravity effects and, with respect to its conveying speed, only determined by the conveying speed of the pair of stops being formed by the guide stop and the end stop.

By operating the portioning stops independently of each other, it is possible to adapt the speed with which the portioning stops circulate on the circulating conveyor to the respective special synchronization conditions when taking over the products from the horizontal conveyor on the one hand and when transferring the products being united in portion units to the vertical conveyor on the other hand.

If the conveying direction of the circulating conveyor is opposite to the conveying direction of the horizontal conveyor and concordant with the conveying direction of the vertical conveyor, and if the circulating conveyor, starting from a take-over portion that is inclined downwards relative to the horizontal level and up to a transfer portion, has a portioning path being increasingly oriented vertically, a conveying connection that is as direct and as short as possible, between the horizontal conveyor and the vertical conveyor, is possible.

If a product is taken over from the horizontal conveyor in the take-over position by means of a take-over device, which is carried over from an arrangement being aligned with a conveying plane of the horizontal conveyor into an arrangement being aligned with a conveying plane of the circulating conveyor, it is not only possible to establish a speed synchronization between the circulating conveyor and the horizontal conveyor, but balancing differing conveying planes of the horizontal conveyor and the circulating conveyor is also possible.

In order to allow for setting the portioning stops in a fashion being exactly adapted to the size of the products to be portioned, it is advantageous if, in the take-over position, the guide stop is initially positioned in a halt position, and if the end stop is advanced against the product after the product has been taken over from the horizontal conveyor.

Transferring the products being united in portion units from the portioning device to the vertical conveyor in an especially product-friendly fashion becomes possible if the guide stop and the end stop, when attaining the transfer position, move in synchronization with the vertical conveyor and in parallel to the same. Hereby, it is in particular ensured that the film web which is continuously moved with the vertical conveyor, and which serves to realize the envelope for the portion units, has the same speed and is moved forward in the same direction at the time of transferring the products.

If, when the portion unit is transferred to the vertical conveyor, the guide stop is accelerated and the end stop is decelerated, it is ensured that the portioning stops are not able to exert a force that affects the transfer of the products onto the portion unit.

In order to ensure that, when a portion unit in a matrix arrangement including at least two product columns being arranged in a matrix row and each having at least one product is transferred, the portion unit is not exposed to an additional force by the portioning stops, it is advantageous if the guide stop is accelerated after the first product column in the conveying direction has been transferred to the vertical conveyor, and if the end stop is decelerated after the last product column in the conveying direction has been transferred to the vertical conveyor.

In order to manufacture a portion unit in a matrix arrangement including at least two product columns being arranged in a matrix row and each having one product, it is especially advantageous if the end stop, after the product of the first product column has been taken over and after the end stop has been advanced against the first product, is moved forward, together with the guide stop, by a product length in the conveying direction into a second halt position, and if the end stop is subsequently advanced into a third halt position, with a backward movement against the conveying direction, in order to realize a receiving interstice for the second product between the first product and the end stop. Consequently, a portion unit can be manufactured that is product-friendly and that has been adapted especially exactly to a multiplicity of products with respect to its length.

In order to manufacture a portion unit in a matrix arrangement including at least two product columns being arranged in a matrix row and each having at least two products that are arranged so as to lie one above the other in a stacking arrangement, it is especially advantageous if the first product of the first product column is taken over by means of a take-over device, which is carried over from an arrangement being aligned with a conveying plane of the horizontal conveyor into an arrangement being aligned with a conveying plane of the circulating conveyor, and if the second product of the same product column is taken over by depositing the second product onto the first product.

Preferably, the product is taken over by means of the take-over device, in such a manner that the product, while carrying over the take-over device into the conveying plane of the circulating conveyor, is exposed to a compressive force, such that the product can be forced to rest against the take-over device and effects of rebounding can at least be lessened. Especially advantageously, a compressive force can be generated by exposing the upper side of the product to a fluid current preferably being realized as an air current.

If a release end pertaining to the horizontal conveyor and being adjustable in its length is pivoted against the take-over portion of the circulating conveyor in such a manner that a conveying plane of the release end, in the take-over position, is arranged in a common plane with a stacking face of the guide stop, by way of the variability of the horizontal conveyor, the portioning device can still be used to manufacture a portion unit in a matrix arrangement including a product column having at least two products that are arranged so as to lie one above the other in a stacking arrangement.

If a multiplicity of pairs of stops circulates on the circulating conveyor, each including one guide stop and one end stop, wherein the guide stops and the end stops are arranged at conveying means of the circulating conveyor that are independent of one another, it is possible to exploit the entire conveying length of the circulating conveyor for the arrangement of positioning stops, such that in particular also the number of the pairs of stops can selected so as to correspond to the distance to be bridged between the horizontal conveyor and the vertical conveyor. Here, in order to minimize the number of conveying means that are needed for driving the portioning stops, it is advantageous if at least two guide stops and at least two end stops of the multiplicity of pairs of stops are driven by means of one conveying means in each instance.

The inventive apparatus for manufacturing packaging units in a tubular bag forming, filling and sealing machine has a horizontal conveyor for transferring separated products to a portioning device, which serves to manufacture portion units with a defined arrangement and number of products, and a vertical conveyor for conveying the portion units, which are enveloped by a film web, to a separating device, which serves to separate the packaging units, wherein the portioning device both serves to manufacture the portion units and is realized to synchronize the portioning device with the horizontal conveyor and the vertical conveyor.

Preferably, the portioning device has at least one pair of stops including two portioning stops that circulate independently of each other on a circulating conveyor, namely a leading guide stop and a trailing end stop, defining a portion unit and being able to be carried over on the circulating conveyor from a take-over position for taking over products from the horizontal conveyor into a transfer position for transferring the products to the vertical conveyor.

In a preferred embodiment, the circulating conveyor is provided with a driving device, which moves the guide stop and the end stop in the direction opposite to the conveying direction of the horizontal conveyor and in the direction concordant with the conveying direction of the vertical conveyor, and the circulating conveyor, starting from a take-over portion that is inclined downwards relative to the horizontal level and up to a transfer portion, has a portioning path being increasingly oriented vertically.

It is especially advantageous if, for taking over a product from the horizontal conveyor in the take-over position, a take-over device is envisaged at the portioning device, which can be carried over from an arrangement being aligned with a conveying plane of the horizontal conveyor into an arrangement being aligned with a conveying plane of the circulating conveyor.

It is especially advantageous if the take-over device has a bearing face being movable translatorily between the conveying planes for depositing the product and a nozzle installation being arranged above the bearing face for exposing an upper side of a product being arranged on the bearing face to a fluid current.

Preferably, the horizontal conveyor, in order to manufacture a portion unit in a matrix arrangement including a product column having at least two products that are arranged so as to lie one above the other in a stacking arrangement, has a release end being adjustable in its length and being connected to a horizontal conveying portion of the horizontal conveyor via a pivot hinge, said release end being able to be pivoted against the take-over portion of the circulating conveyor in such a manner that a conveying plane of the conveying bracket, in the take-over position, is arranged in a common plane with a stacking face of the guide stop.

Furthermore, it is preferred if a multiplicity of circulating pairs of stops is envisaged on the circulating conveyor, each including one guide stop and one end stop, wherein the guide stops and the end stops are arranged at conveying means of the circulating conveyor that are independent of one another.

Preferably, at least two guide stops and at least two end stops of the multiplicity of pairs of stops are arranged at one conveying means in each instance.

In the following, with the aid of the drawing, preferred embodiments of the method in accordance with the invention as well as apparatuses being employed here are explained in more detail.

Figure 2:
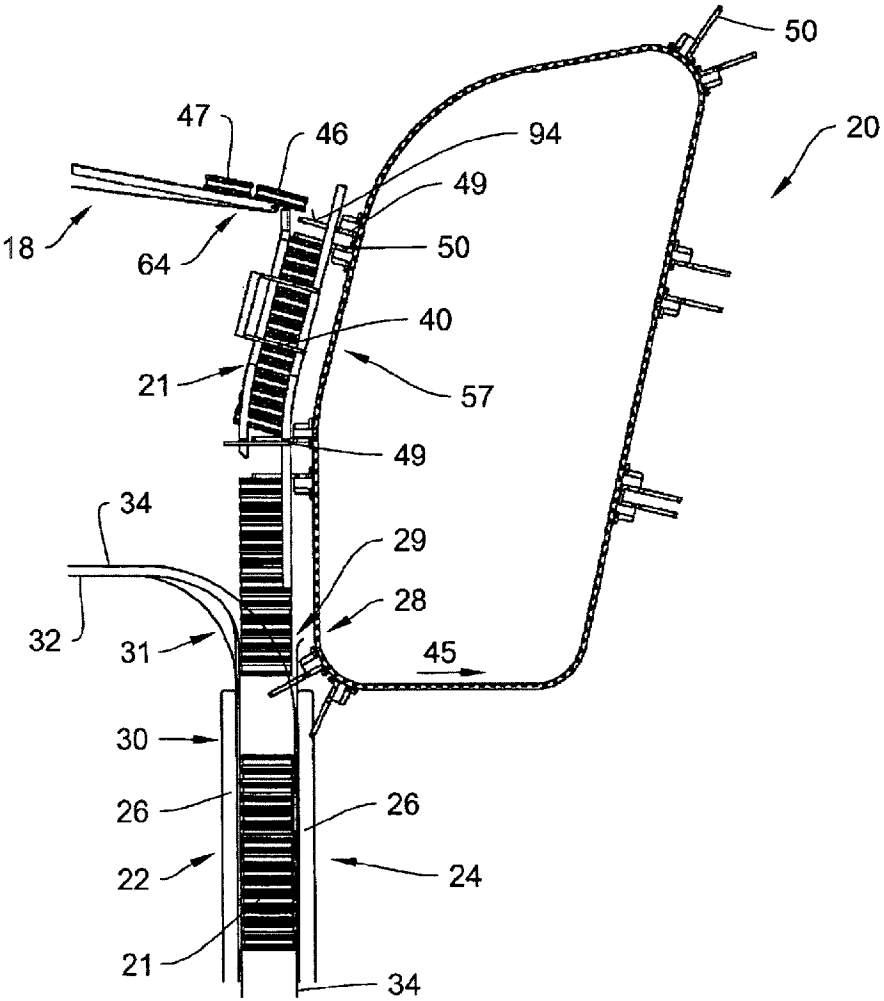
Figure 3:
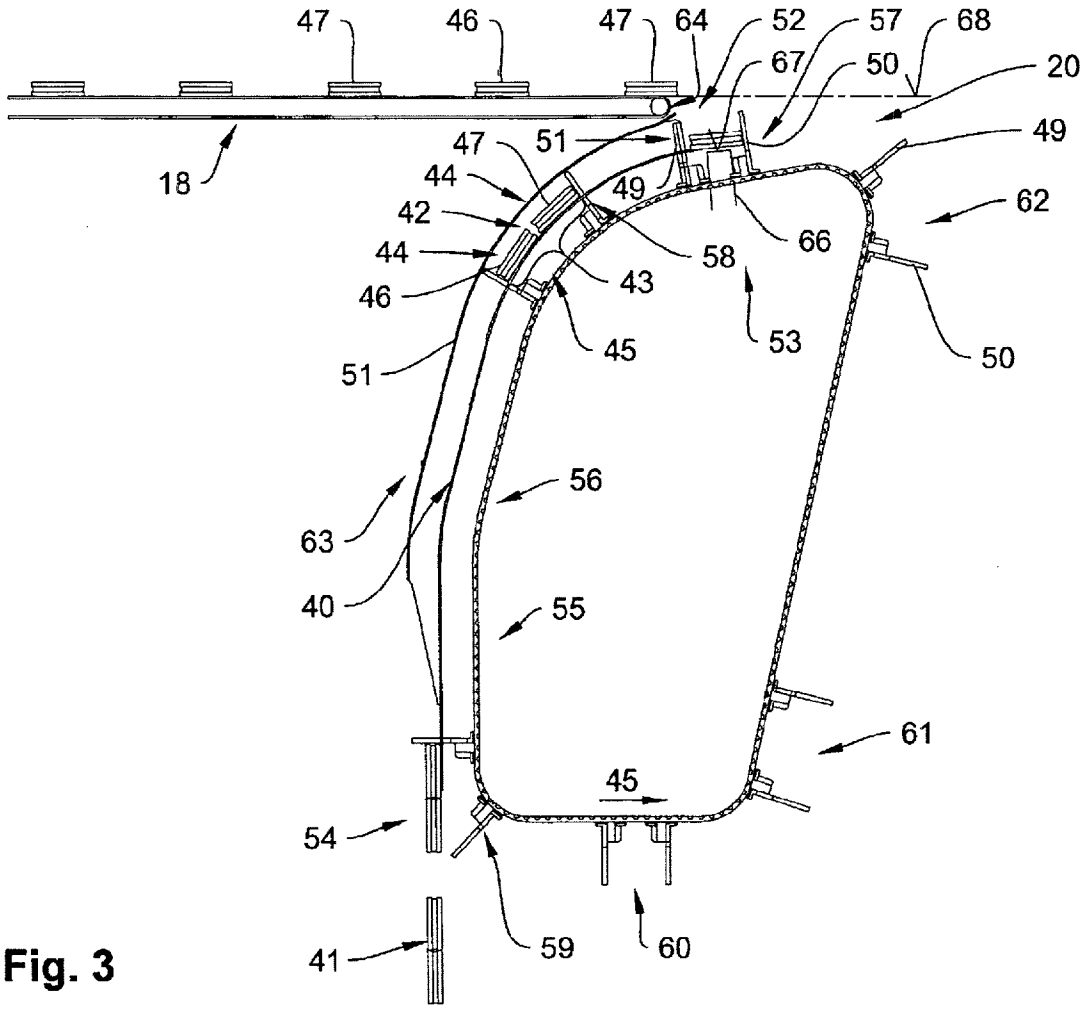
Figure 4:
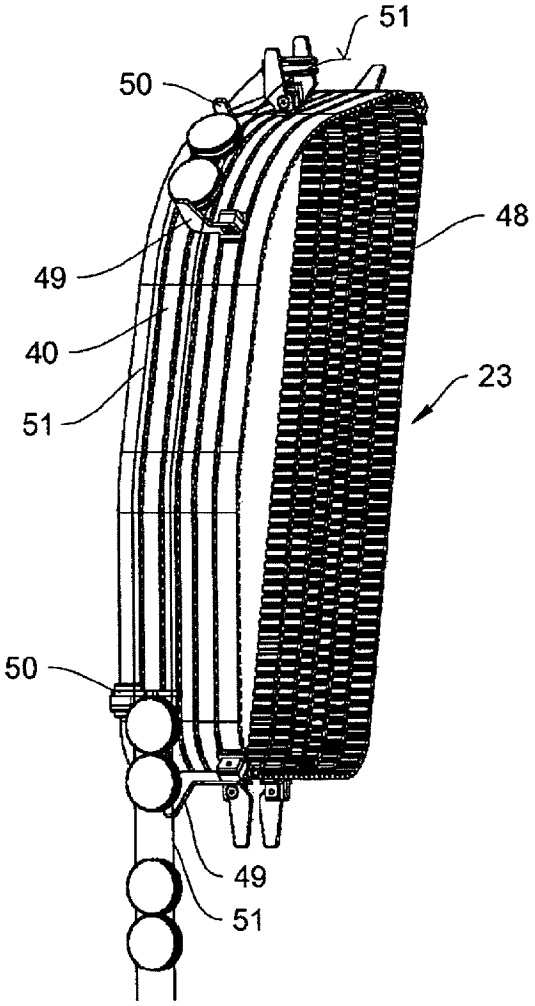
Figure 5:
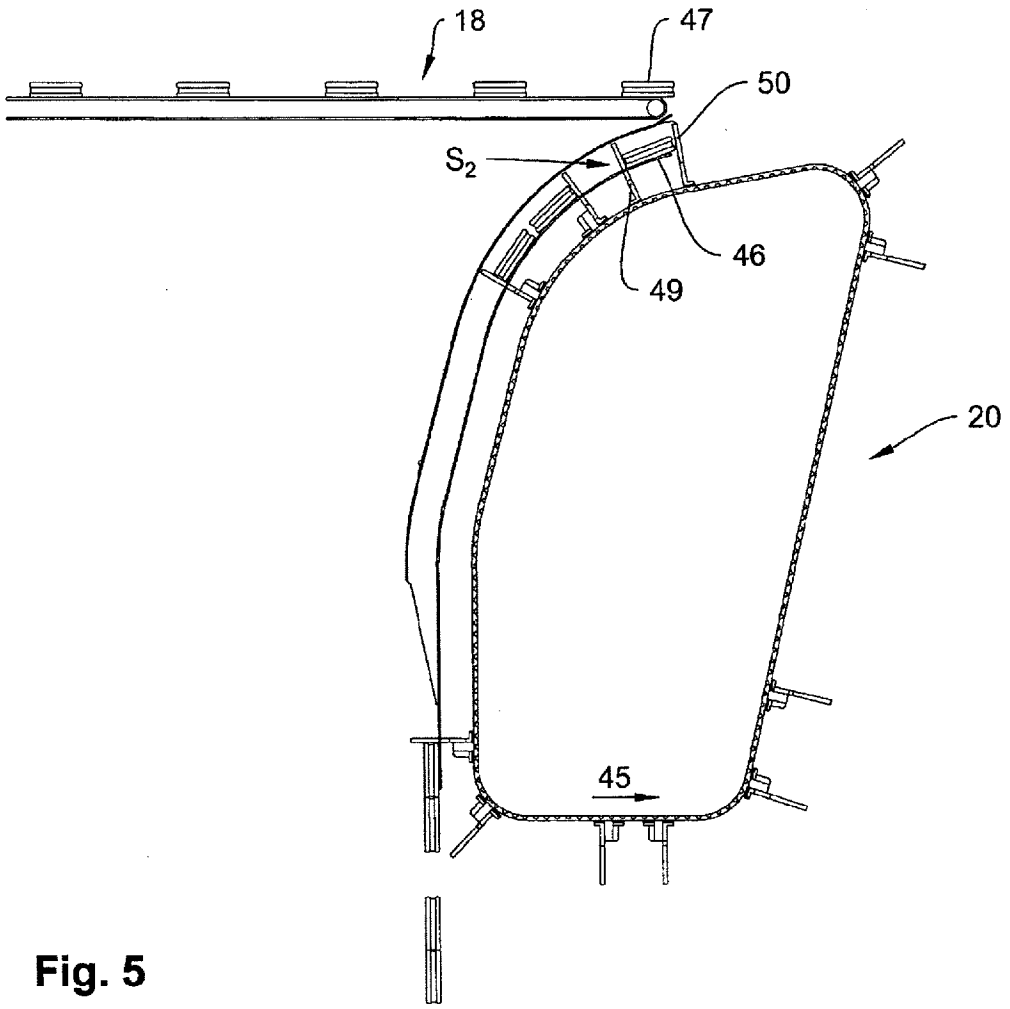
Figure 6:
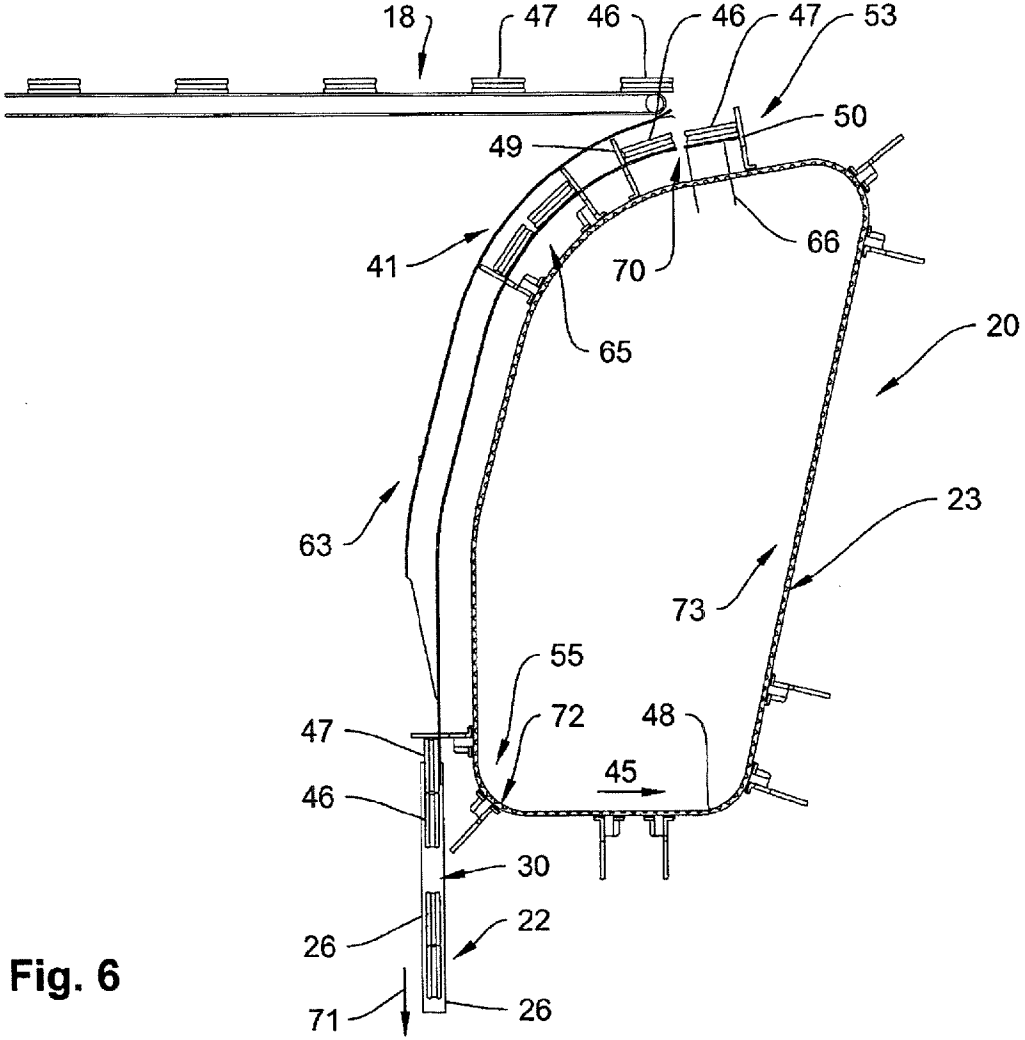
Figure 7:
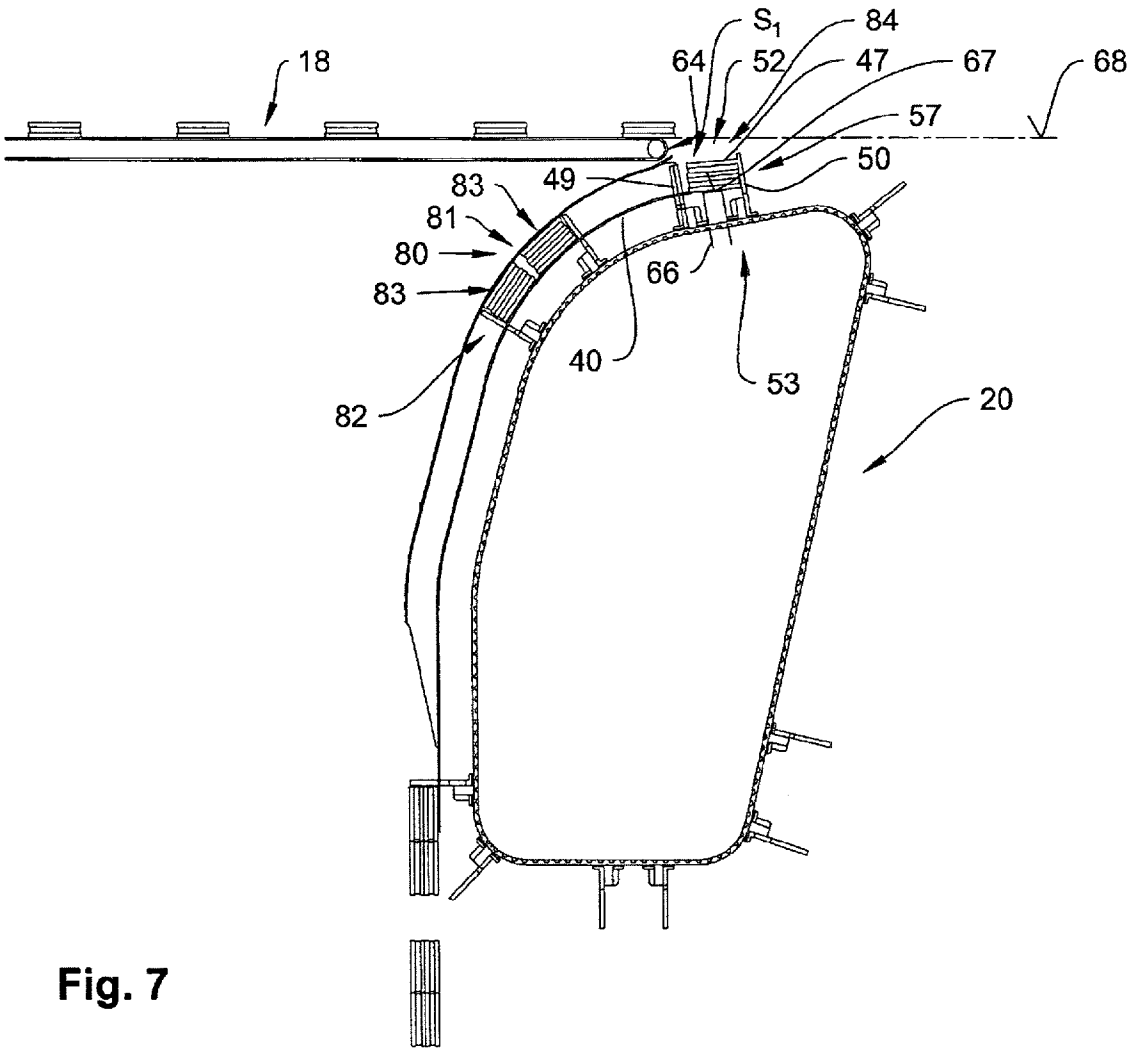
Figure 8:
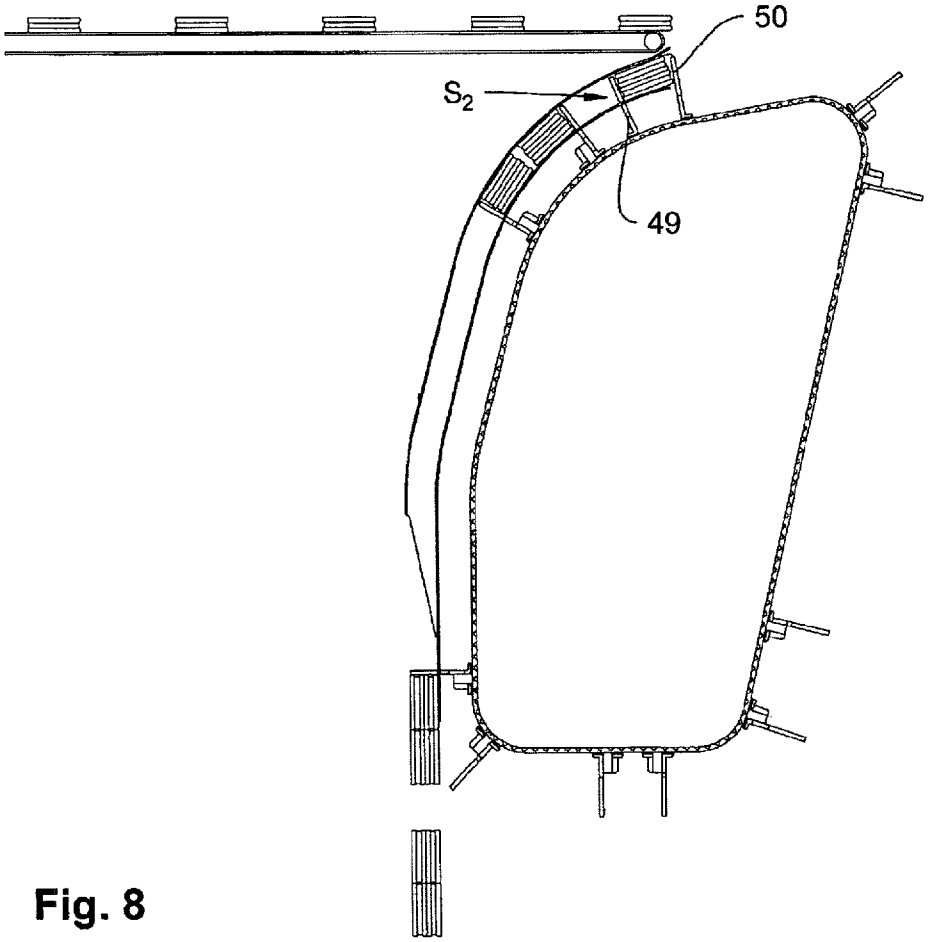
Figure 9:
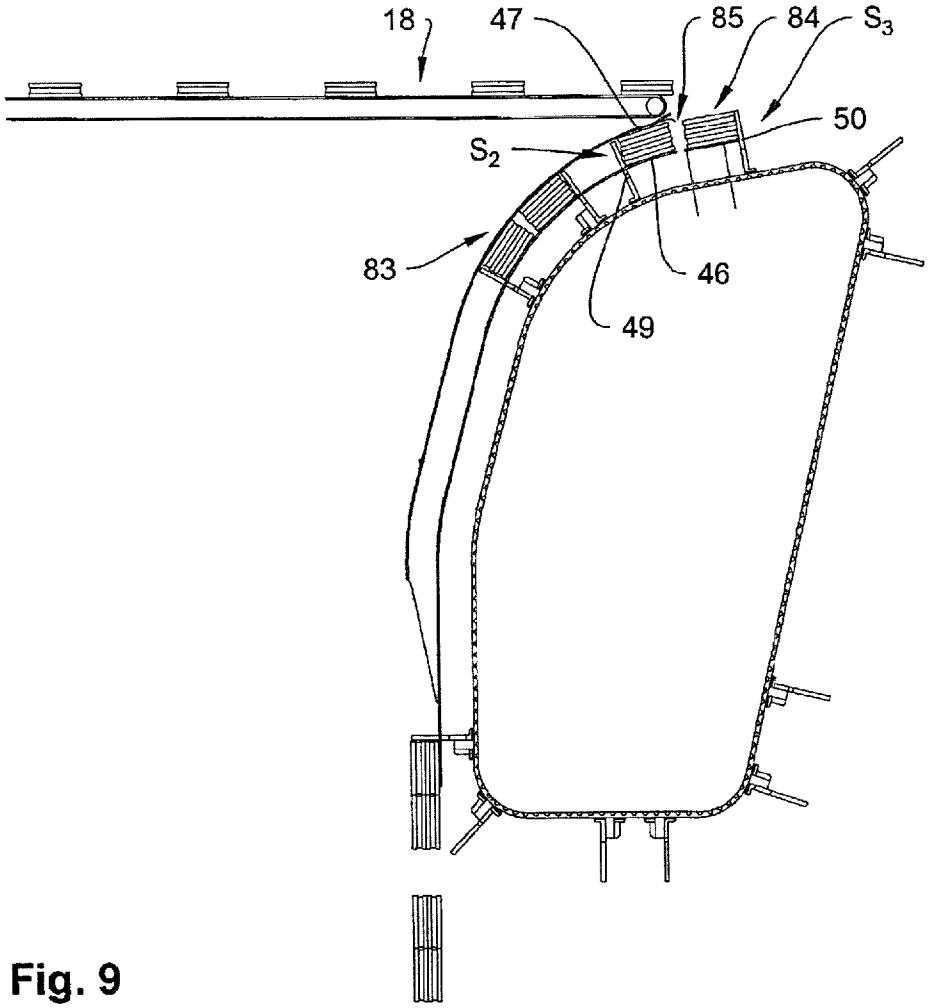

In the figures:

FIG. 1: shows a packaging apparatus having a variable horizontal conveyor in a side view;

FIG. 2: shows the packaging apparatus being illustrated in FIG. 1, with the horizontal conveyor being arranged in a radial configuration;

FIG. 3: shows the packaging apparatus being illustrated in FIG. 1, with the horizontal conveyor being arranged in a tangential configuration;

FIG. 4: shows a portioning device of the packaging apparatus in an isometric illustration;

FIGS. 5, 6: show the packaging apparatus being illustrated in FIG. 3 in successive phases of manufacturing a portion unit comprising two products;

FIGS. 7-9: show the packaging apparatus being illustrated in FIG. 3 in successive phases of manufacturing a portion unit comprising four products.

FIG. 1 shows a packaging apparatus 17 of a packaging system which is not illustrated in more detail below, and which has a horizontal conveyor 18, with which separated and stackable products 46, 47, being realized in the shape of disks by way of example, and being realized as a cookie in the present case, are transferred to a portioning device 20. Said portioning device, as a function of whether the horizontal conveyor 18 is in a radial configuration being illustrated with the help a continuous line or in a tangential configuration being illustrated with the help of broken lines, serves to manufacture a portion unit 21 being realized as a stacking arrangement or to manufacture a portion unit 41 being realized as a linear arrangement. For portioning purposes and, simultaneously, for the purpose of conveying the realized portion units 21 on to a vertical conveyor 22, the portioning device 20 has a circulating conveyor 23, the portion units 21, 41 being transferred from the same to the vertical conveyor 22.

The portion unit 21 being illustrated in FIG. 2 is realized in such a manner that the products 46, 47 are supplied, following one after another, to the portioning device 20 by means of the release end 64 pertaining to the horizontal conveyor 18 and being arranged so as to be radial with respect to a guide track 40. Here, the first product 46 is deposited on a stacking face 94 being formed by a guide stop 49 and the further products 47, 46 are arranged as a stacking arrangement lying one above the other, wherein the guide stop 49 with the stacking face 94 is moved forward, corresponding to the growth of the stacking arrangement, in the conveying direction 45 of the portioning device 20 until the stacking height corresponding to the portion unit 21 has been attained. In the following, an end stop 50 is advanced against the stacking arrangement, such that the portion unit 21 is determined as a coherent and compact unit with products resting against one another, independently of any gravity effects and, with respect to its conveying speed, only by the conveying speed of a pair of stops 57 being formed by the guide stop 49 and the end stop 50, along the guide track 40.

As in particular FIG. 2 shows, the vertical conveyor 22, in the present case, substantially consists of two circulating conveyors 24 being arranged so as to be vertical and parallel with respect to each other, each having a belt conveyor 26, wherein the belt conveyors 26 realize a conveying channel 30 by way of their distance, with a draw-in opening 29 being realized at a transfer end 28 of the portioning device 20.

A film web deflecting installation 31 is situated in the region of the transfer end 28 of the portioning device 20. Via said film web deflecting installation, a film web 34 being conveyed thereto along a film web supply installation 32 of the vertical conveyor 22 and being driven via a film take-off installation that is arranged below the vertical conveyor 22 and that is not illustrated in more detail here is introduced into the conveying channel 30 being realized between the belt conveyors 26 such that the film web 34 surrounds the portion unit 21, enveloping the same, in the region of the draw-in opening 29 of the conveying channel 30 and is moved through the conveying channel 30 together with the portion unit 21.

An overlap region being realized in the process, of film web longitudinal edges, is fixed by means of a longitudinal sealing installation being arranged in the lower region of the conveying channel 30 and not being illustrated in more detail here, such that, following the longitudinal sealing installation, both below and above the portion unit 21, after a transverse sealed seam has been manufactured, in a transverse sealing installation not being illustrated here in more detail, the film web 34 that has been shaped into a film tube may be cut through and packaging units each containing a portion unit 21 may thus be separated.

FIGS. 3-6 show the portioning device 20 having the horizontal conveyor 18 in a tangential configuration in different phases of manufacturing portion units 41, which, in a matrix arrangement 42 having a matrix row 43 and two product columns 44, each have a product 46 or 47, which means all in all two products 46, 47 being arranged so as to lie one behind the other in a conveying direction 45 of the circulating conveyor 23.

FIG. 3 shows how, in a starting phase of manufacturing a portion unit 41, separated products 46, 47 are conveyed from the horizontal conveyor 18 to the portioning device 20. Said portioning device, as it is illustrated in FIG. 4, has conveying means being realized on the circulating conveyor 23 as conveying straps 48, and being provided with two portioning stops in each instance in the present case, which portioning stops are each realized as a guide stop 49 or as an end stop 50 and are partially situated on the back of the circulating conveyor 23 in the phase being illustrated in FIG. 4.

One guide stops 49 and one end stop 50 of conveying straps 48 being assigned to each other define a portioning frame 65, together with side rails 51 being arranged at the side of the guide track 40, the products 46, 47 moving between said side rails in the circulating direction 45. The portion unit 41 is conveyed in said portioning frame along the guide track 40 from a take-over position 52 (FIG. 3) in a take-over portion 53 of the circulating conveyor 23 into a transfer position 54 (FIG. 3) in a transfer portion 55.

As FIG. 3 shows, the take-over portion 53 of the circulating conveyor 23 is slightly inclined downwards relative to the horizontal level and finally, in the longitudinal sense of a ramp portion 56, merges into the transfer portion 55 being vertically oriented. In the portioning device 20 being illustrated in FIGS. 3-6, six pairs of stops 57, 58, 59, 60, 61 and 62 are all in all envisaged, each having one guide stop 49 and one end stop 50. Said pairs of stops can be moved both independently of one another and simultaneously and concordantly, by the conveying straps 48, wherein portion units 41, by means of the pairs of stops 57-62, are always only realized in the region of a portioning path 63 being realized between the take-over position 52 and the transfer position 54.

FIG. 3 shows the pair of stops 57 in the take-over position 52, in which pair the guide stop 49 and the end stop 50 are situated in the take-over portion 53, being arranged in such a manner that a product 46, after having been conveyed via the release end 64, arrives in the portioning frame 65 being formed by the pair of stops and by the side rails 51 being arranged at the side. In order to guarantee a take-over that is as product-friendly as possible from the release end 64 of the horizontal conveyor 18 into the portioning frame 65, a take-over device 66 is envisaged in the take-over portion 53 of the circulating conveyor 23, said take-over device being realized as an eccentric disk here, and being situated in an extended position when the product is taken over from the horizontal conveyor 18, in such a manner that a bearing face 67 of the take-over device 66 is situated in a conveying plane 68 of the horizontal conveyor 18. Subsequently, the take-over device 66 is lowered in such a manner that the product 46 rests on the guide track 40, wherein the guide stop 49 is situated in a halt position $S_1$ at the time of taking over the product 46 from the horizontal conveyor 18.

After the product 46 has been taken over from the horizontal conveyor 18, the end stop 50 being driven by a further conveying strap 48 independently of the guide stop 49 is advanced against the product 46 in the conveying direction 45 and the guide stop 49 is moved into a second halt position $S_2$ being illustrated in FIG. 5, such that the product 46 is received between the guide stop 49 and the end stop 50 in a defined fashion.

Subsequently, as it is illustrated in FIG. 6, the end stop 50, with a backward movement 69 against the conveying direction 45, is advanced into a halt position $S_3$ in order to realize a receiving interstice 70 for receiving the second product 47 between the first product 46 and the end stop 50. The second product 47 is then again taken over from the horizontal conveyor 18 by means of the take-over device 66.

After the second product 47 has been arranged in the receiving interstice 70, for arranging the portion unit 41 consequently having the products 46, 47 in a matrix arrangement 42 in a defined fashion, the end stop 50 is advanced against product 47.

At the end of the portioning path 63 of the portioning device 20, along which the portion unit 41 is conveyed by means of a thrusting of the guide stop 49 and of the end stop 50 that is simultaneous for keeping up the portioning frame 65, the portion unit 41 arrives in the transfer portion 55 of the portioning device 20, said portion being arranged so as to be parallel to the conveying channel 30 of the vertical conveyor 22. In the region of the transfer portion 55, the portion unit 41 is transferred to to the belt conveyors 26 pertaining to the vertical conveyor 22 and defining the conveying channel 30, in such a manner that the products 46, 47 are held between the belt conveyors 26 being vertically driven in the conveying direction 71, maintaining the relative arrangement that is defined by the portion unit 41.

As it was explained at the beginning with reference to FIG. 3, the film web 34 is here situated in an arrangement enveloping the products 46, 47, such that the film web 34 is arranged between the belt conveyors 26 and the products 46, 47 and is vertically moved forward in the conveying direction 71, simultaneously with the belt conveyors 26 on the one hand as well as with the products 46, 47 on the other hand.

For transferring the portion unit 41 to the vertical conveyor 22, the belt conveyors 26 of the vertical conveyor 22 and the conveying straps 48 pertaining to the circulating conveyor 23 and being assigned to the guide stop 49 and to the end stop 50 have the same speed. In order to ensure that the portion unit 41, when being transferred to the vertical conveyor 22, is not influenced by the application of a force by the guide stop 49 or by the end stop 50, after the product 46 being in the front in the conveying direction 45 has been transferred and before a deflection portion 72 being joined to the transfer portion 55 has been attained, which deflection portion carries the conveying straps 48 of the circulating conveyor 23 into a recirculating portion 73, the guide stop 49 is accelerated. Correspondingly, after the product 47 being in the rear in the conveying direction 45 has been transferred to the vertical conveyor 22, the end stop 50 is decelerated.

FIGS. 7-9 show the portioning device 20 when a portion unit 80 is being manufactured, which, as FIG. 7, for instance, shows, is realized in a matrix arrangement 81 including two product columns 83 being arranged in a matrix row 82, said columns each having two products 46, 47 in a stacking arrangement 84.

For manufacturing the stacking arrangement 84, starting from a halt position $S_1$ of the guide stop 49 and of the end stop 50, which are situated in the take-over portion 53 in the take-over position 52, a first product 46 is initially taken over, which is transferred onto the bearing face 67 of the take-over device 66 via the release end 64 of the horizontal conveyor 18, said bearing face being lifted into the conveying plane 68 of the horizontal conveyor 18, and is subsequently lowered onto the guide track 40 as a result of a lowering movement of the bearing face 67.

Subsequently, the pair of stops 57 remains in the halt position $S_1$ and the following product 47 is transferred from the horizontal conveyor 18 via the release end 64 thereof onto the first product 46 that has already been received between the guide stop 49 and the end stop 50, for realizing the stacking arrangement 84.

In the following, the products 46, 47 realizing the first product column 83 of the matrix arrangement 81 are moved forward, by means of a synchronous forward movement of the guide stop 49 and of the end stop 50, by a product length in the conveying direction 45 into a second halt position $S_2$, and, for realizing the second product column 83, the end stop 50 is moved up to a halt position $S_3$, in which a receiving interstice 85 is realized between the products 46, 47 of the first product column 83 being arranged one above the other in a stacking arrangement 84 and the end stop 50, said receiving interstice being filled with two further products 46, 47 in a stacking arrangement 84, wherein, corresponding to fashion in which the first product column 83 is realized, the first product 46 of the second product column 83 is lowered onto the guide track 40 by means of the take-over device 66 and the second product 47 is put onto the first product 46.

FIG. 1 shows the horizontal conveyor 18 being assigned to the portioning device 20 in two different configurations, wherein, in the tangential configuration, the release end 64 being pivotably connected to a horizontal conveying portion 90 via a pivot hinge 89 is oriented substantially tangentially with respect to the guide track 40 of the portioning device 20 and, in a radial configuration, the release end 64, which can telescopically be adjusted with respect to its length, is oriented substantially radially with respect to the guide track 40.

In the tangential configuration, the horizontal conveyor 18, as it is illustrated in FIGS. 3 and 5 to 9, allows for tangentially supplying the products 46, 47 in order to manufacture portion units 41 and 80 with several product columns 44, 83. In the radial configuration, the horizontal conveyor 18, as it is illustrated in FIG. 2, allows for radially supplying the products 46, 47 in order to manufacture portion units 21, in that the conveying plane 68 of the release end 64 is arranged, in a take-over position 93, substantially in a common plane with a stacking face 94 of the guide stop 49.

The radial configuration of the horizontal conveyor 18 consequently allows for manufacturing portion units 21 in a matrix arrangement including a product column, wherein the stacking face 94 of the guide stop 49 is exploited for a stacking arrangement of products 46, 47 being arranged so as to lie immediately one above the other.

From the remarks hereinbefore with respect to explaining the different variants being illustrated in the drawing figures of manufacturing portion units, it becomes clear that, independently of the respective design of the portion unit, which means independently of whether a portion unit 41, as it is illustrated in FIGS. 3 to 6, or a portion unit 80, as it is illustrated in FIGS. 7 to 9, or a portion unit 21, as it is illustrated in FIG. 2, is concerned, the same portioning device 20 is always employed. Consequently, there is a substantial advantage of the portioning device 20 with respect to its universal applicability, which makes converting portioning units, as it has been common to date, or even replacing whole portioning units, as a prerequisite for manufacturing to different portion units, redundant.

The invention claimed is:

1. A method for manufacturing packaging units in a tubular bag forming, filling and sealing machine, said method comprising:

transferring separated products to a portioning device using horizontal conveyor in order to manufacture portion units with a defined arrangement and number of products, the portioning device including a leading guide stop and a trailing end stop that circulate independently of each other on a circulating conveyor, said leading guide stop and said trailing end stop resting against the products to form a portion unit comprising products that rest against one another;

conveying the portion units, which are enveloped by a film web with a vertical conveyor, wherein the portioning device is used both to manufacture the portion units and to synchronize the portioning device with the horizontal conveyor and the vertical conveyor; and transporting the leading guide stop, the portion unit, and the trailing end stop together on the circulating conveyor from a take-over position for receiving products from the horizontal conveyor to a transfer position for transferring the products to the vertical conveyor, and wherein to manufacture a portion unit in a matrix arrangement including at least first and second product columns each having one product arranged in a matrix row, after a first product of a first product column has been received and after the trailing end stop has been advanced against the first product, further comprising moving the end stop forward together with the leading guide stop by a product length in the conveying direction into a second halt position, and subsequently advancing the trailing end stop with a backward movement against the conveying direction into a third halt position, to cause a receiving interstice for a second product between the first product and the end stop.

2. The method according to claim 1, in which the conveying direction of the circulating conveyor is opposite to the conveying direction of the horizontal conveyor in accordance with the conveying direction of the vertical conveyor, and in that the circulating conveyor is inclined downwards relative to the horizontal level starting from the take-over portion and up to a transfer portion, and has a portioning path increasingly oriented vertically.

3. The method according to claim 1, in which a product is taken over from the horizontal conveyor in the take-over position using a take-over device, which is transported from an arrangement being aligned with a conveying plane of the horizontal conveyor into an arrangement being aligned with a conveying plane of the circulating conveyor.

4. The method according to claim 1, in which in the take-over position, the guide stop is initially positioned in a halt position, and in that the end stop is advanced against the product after the product has been taken over from the horizontal conveyor.

5. The method according to claim 1, in which the method includes moving a leading guide stop and the trailing end stop parallel to and in synchronization with the vertical conveyor when reaching the transfer position.

6. The method according to claim 1, in which when the portion unit is transferred to the vertical conveyor, the guide stop is accelerated and the end stop is decelerated.

7. The method according to claim 6, in which when a portion unit in a matrix arrangement including at least two product columns arranged in a matrix row and each having at least one product is transferred, the guide stop is accelerated after the first product column in the conveying direction has been transferred to the vertical conveyor, and the end stop is decelerated after the last product column in the conveying direction has been transferred to the vertical conveyor.

8. The method according to claim 1, in which a multiplicity of pairs of stops circulates on the circulating conveyor, each including one leading guide stop and one trailing end stop, wherein the leading guide stops and the trailing end stops are arranged at the circulating conveyor that are independent of one another.

9. The method according to claim 8, in which at least two leading guide stops and at least two trailing end stops of the multiplicity of pairs of stops are driven in each instance.

10. A method for manufacturing packaging units in a tubular bag forming, filling and sealing machine, said method comprising:

transferring separated products to a portioning device using horizontal conveyor in order to manufacture portion units with a defined arrangement and number of products, the portioning device including a leading guide stop and a trailing end stop that circulate independently of each other on a circulating conveyor, said leading guide stop and said trailing end stop resting against the products in order to form a portion unit that is composed of products that rest against one another;

conveying the portion units, which are enveloped by a film web, with a vertical conveyor, the portioning device is used both to manufacture the portion units and to synchronize the portioning device with the horizontal conveyor and the vertical conveyor; and transporting the leading guide stop and the trailing end stop together with the portion unit being received therebetween, on the circulating conveyor from a take-over position for receiving products from the horizontal conveyor into a transfer position for transferring the products to the vertical conveyor, and in which in order to manufacture a portion unit in a matrix arrangement including at least two product columns being arranged in a matrix row and each having at least two products that are arranged so as to lie one above the other in a stack arrangement, the first product of the first product column is received by a take-over device, which is transported from an arrangement being aligned with a conveying plane of the horizontal conveyor into an arrangement being aligned with a conveying plane of the circulating conveyor, and the second product of the same product column deposited onto the first product.

11. The method according to claim 10, in which the product is exposed to a compressive force while transporting the take-over device into the conveying plane of the circulating conveyor.

12. The method according to claim 11, in which the compressive force is generated by exposing the upper side of the product to a fluid current.

13. An apparatus for manufacturing packaging units in a tubular bag forming, filling and sealing machine, said apparatus comprising:

a portioning device manufacturing portion units with a defined arrangement and number of products;

a horizontal conveyor transferring separated products to the portioning device;

a vertical conveyor conveying the portion units, which are enveloped by a film web, wherein the portioning device both manufactures the portion units and synchronizes the portioning device with the horizontal conveyor and the vertical conveyor, wherein the portioning device includes a leading guide stop and a trailing end stop that circulate independently of each other on a circulating conveyor, defining a portion unit and being transportable on the circulating conveyor from a take-over position for taking over products from the horizontal conveyor into a transfer position for transferring the products to the vertical conveyor, and wherein the circulating conveyor has a driving device, which moves the leading guide stop and the trailing end stop in the direction opposite to the conveying direction of the horizontal conveyor and in the direction in accordance with the conveying direction of the vertical conveyor, and in that the circulating conveyor, starting from a take-over portion that is inclined downwards relative to the horizontal level and up to a transfer portion, has a track outline being increasingly oriented vertically, and in which the horizontal conveyor, in order to manufacture a portion unit in a matrix arrangement including a product column having at least two products that are arranged so as to lie one above the other in a stack arrangement, has a release end being adjustable in its length and being connected to a horizontal conveying portion of the horizontal conveyor via a pivot hinge, said release end being able to be pivoted against the take-over portion of the circulating conveyor in such a manner that a conveying plane of the conveying bracket, in the take-over position, is arranged in a common plane with a stacking face of the leading guide stop.

14. The apparatus according to claim 13, in which for receiving a product from the horizontal conveyor in the take-over position, a take-over device (66) is envisaged at the portioning device, which can be transported from an arrangement being aligned with a conveying plane of the horizontal conveyor into an arrangement being aligned with a conveying plane of the circulating conveyor.

15. The apparatus according to claim 14, in which the take-over device has a bearing face being translatable between the conveying planes for depositing the product.

16. The apparatus according to claim 13, in which a plurality of circulating pairs of stops is envisaged on the circulating conveyor, each including one leading guide stop and one trailing end stop, wherein the leading guide stops and the trailing end stops are arranged at the circulating conveyor that are independent of one another.

17. The apparatus according to claim 16, in which at least two leading guide stops and at least two trailing end stops of the plurality of pairs of stops are arranged at one conveyance in each instance.

* * * * *